United States Patent [19]

Fulks et al.

[11] Patent Number: 4,727,301

[45] Date of Patent: Feb. 23, 1988

[54] DOOR LOCKING SYSTEM

[75] Inventors: Gary C. Fulks, Buckinghamshire; David A. McKernon, West Sussex; Voja Savic, Bedfordshire, all of England

[73] Assignee: Delco Products Overseas Corporation, Detroit, Mich.

[21] Appl. No.: 838,697

[22] Filed: Mar. 12, 1986

[30] Foreign Application Priority Data

Mar. 21, 1985 [GB] United Kingdom ..... 8507354

[51] Int. Cl.[4] ..... E05B 65/36

[52] U.S. Cl. ..... 318/468; 318/293; 70/278; 292/DIG. 3; 292/DIG. 23

[58] Field of Search ..... 318/255, 256, 280, 286, 318/293, 442, 466, 468; 49/279, 280, 302; 70/91, 237, 275, 277, 278, DIG. 11; 292/144, 201, DIG. 3, DIG. 23

[56] References Cited

U.S. PATENT DOCUMENTS

| | | | |
|---|---|---|---|
| 4,232,256 | 11/1980 | Moriconi et al. | 318/292 |
| 4,342,209 | 8/1982 | Kleefeldt | 70/264 |
| 4,631,460 | 12/1986 | Reichmann | 318/280 |
| 4,648,781 | 3/1987 | Sikora | 318/468 |
| 4,666,026 | 5/1987 | Poulin | 192/141 |

FOREIGN PATENT DOCUMENTS

| | | |
|---|---|---|
| 3008964 | 9/1981 | Fed. Rep. of Germany . |
| 3031066 | 6/1982 | Fed. Rep. of Germany . |
| 2911681 | 11/1982 | Fed. Rep. of Germany . |
| 2034802 | 6/1980 | United Kingdom . |

*Primary Examiner*—Bentsu Ro

*Attorney, Agent, or Firm*—Charles E. Leahy

[57] ABSTRACT

An electrically-operable actuator 10, for use in locking and unlocking a latch mechanism in a motor vehicle by the selective operation of a switchable direct current electrical supply to said actuator, comprises a housing 12, 14 enclosing a reversible direct current electric motor 16 adapted to be coupled to said electrical supply, a reduction gear train, a reciprocable member 96 movable between two predefined limits and adapted at one end to be coupled with a locking lever of said latch mechanism, and a rotary, load-sensitive releasable coupling 64 provided between said reversible electric motor 16 and said reciprocable member 96, the actuator including a releasably-engagable locking lever 132 which is operable to lock said reciprocable member 96 against any movement relative to said housing 12, 14, said locking lever 132 being applied, when the actuator 10 is coupled to said switchable electrical supply and after one of said predetermined limits has been reached, by the operation of a switch means in said supply to provide an electrical pulse to said electric motor 16 at a predetermined voltage, lower than the normal operating voltage of said electric motor 16, for a short predetermined period of time.

8 Claims, 7 Drawing Figures

DOOR LOCKING SYSTEM

This invention relates to electrically-operable actuators for use in locking and unlocking latch mechanisms in a motor vehicle by the selective operation of a switchable direct current electrical supply to said actuators, and, in particular, it relates to electrically-operable actuators which comprise a housing enclosing a reversible direct current electric motor adapted to be coupled to said electrical supply, a reduction gear train, a reciprocable member movable between two predefined limits and adapted at one end to be coupled with a locking lever of said latch mechanism, and a clutch means provided between said reversible electric motor and said reciprocable member.

Background of the Invention

It is customary in motor vehicles particularly private motor vehicles, for one or more doors of the vehicle to be provided with door latch mechanisms which have a manual release mechanism inside the vehicle and a key-operated mechanism accessible from outside of the vehicle. Many private motor vehicles are now being produced with centralised door locking systems, in which a key-operated mechanism accessible from outside the motor vehicle can be used to lock or unlock all of the doors of the vehicle substantially simultaneously. Such centralised door locking systems are based upon the concept of providing electrically-operable door lock actuators in all of the vehicle doors not mechanically connected to the key-operated mechanism, each of these door lock actuators being connected electrically to a control circuit including said key-operated mechanism.

One known form of centralised door lock actuator is one which includes a reversible direct current electric motor, a reduction gear train and a reciprocable member adapted at one end to be coupled with a locking lever of a motor vehicle door latch mechanism, there being a clutch means provided between said reversible electric motor and said reciprocable member so that manual operation of the locking lever of the motor vehicle door latch mechanism to which the actuator is coupled does not necessitate consequent rotation of the electric motor of the actuator.

A small, compact actuator of this type is disclosed in and claimed in our co-pending British patent application No. 8412861, and the present invention constitutes an improvement of the electrically-operable actuator disclosed and claimed in that British patent application.

There is a growing need to protect motor vehicles and their contents against attempted theft, and, in particular, to improve the security of lockable latch mechanisms as used on vehicle doors. Consequently, centralised door locking systems employing electrically-operable actuators can have the security thereof improved by providing additional means in each actuator to ensure that the movable parts of the actuator are locked against movement by any person attempting to gain illegal entry to a motor vehicle through a vehicle door equipped with such a centralised locking system.

An acceptable way of releasably locking such an electrically-operable actuator against movement is by arranging for the moving components of the actuator to be electrically driven into a locking position, termed a "super lock" position, by supplying electrical power to the electric motor of the actuator through a subsidiary switch means. Such a switch means can be independent of the key-operated mechanism of the known centralised door locking systems, or it can be incorporated within the key-operated mechanism so as to be actuated by a further turn of the key within the key-operated mechanism.

Summary of the Invention

An electrically-operable actuator according to the present invention, for use in locking and unlocking a latch mechanism in a motor vehicle by the selective operation of a switchable direct current electrical supply to said actuator, comprises a housing enclosing a reversible direct current electric motor adapted to be coupled to said electrical supply, a reduction gear train, a reciprocable member movable between two predefined limits and adapted at one end to be coupled with a locking lever of said latch mechanism, and a clutch means provided between said reversible electric motor and said reciprocable member, and is characterised in that said clutch means is a rotary load-sensitive releasable coupling within said reduction gear train which disengages said reciprocable member from said reversible electric motor at either of said predetermined limits, and the actuator also includes a releasably-engagable stop means between said housing and said reciprocable member which is operable to lock said reciprocable member against any movement relative to said housing, said stop means being applied, when said actuator is coupled to said switchable electrical supply and after one of said predetermined limits has been reached, by the operation of a switch means in said supply to provide an electrical pulse to said electric motor at a predetermined voltage, lower than the normal operating voltage of said electric motor, for a predetermined short period of time.

Preferably, this stop means is operable by reversing the direction of rotation of said electric motor once said one predetermined limit has been reached.

In a preferred embodiment of the present invention, the stop means is a locking lever pivotally mounted within the housing of the actuator, and having one end thereof shaped with formations thereon releasably engagable with complimentary formations on the reciprocable member, and the other end thereof shaped with a cam follower thereon, the locking lever being resiliently biased to retain the cam follower thereon in the path of a cam portion formed upon a driving member of the releasable coupling. Preferably, in this preferred embodiment, the locking lever is formed from a synthetic plastics material and includes a resilient finger portion which bears against a portion of the housing to provide the resilient bias on the locking lever.

Advantageously, in this preferred embodiment of the invention, the locking lever is pivotally mounted within the housing by means of integral pivot portions of said locking lever, each of which is retained within a corresponding substantially U-shaped pivot mounting in the housing to produce a respective floating pivot point for said locking lever.

In the preferred embodiment of the invention, it is preferable to provide the releasable coupling with a limit stop portion which is operable, when the stop means is applied, to prevent disengagement of said cam follower from said cam portion, said limit stop portion being over-ridden when the electric motor of the actuator is driven with said normal operating voltage. Such a limit stop portion may be located on a driven member of the releasable coupling or, alternatively, may be located on the driving member of the releasable coupling.

BRIEF DESCRIPTION OF THE DRAWINGS

The invention and how it may be performed are hereinafter particularly described with reference to the accompanying drawings, in which.

DESCRIPTION OF PREFERRED EMBODIMENT

Figure 1:
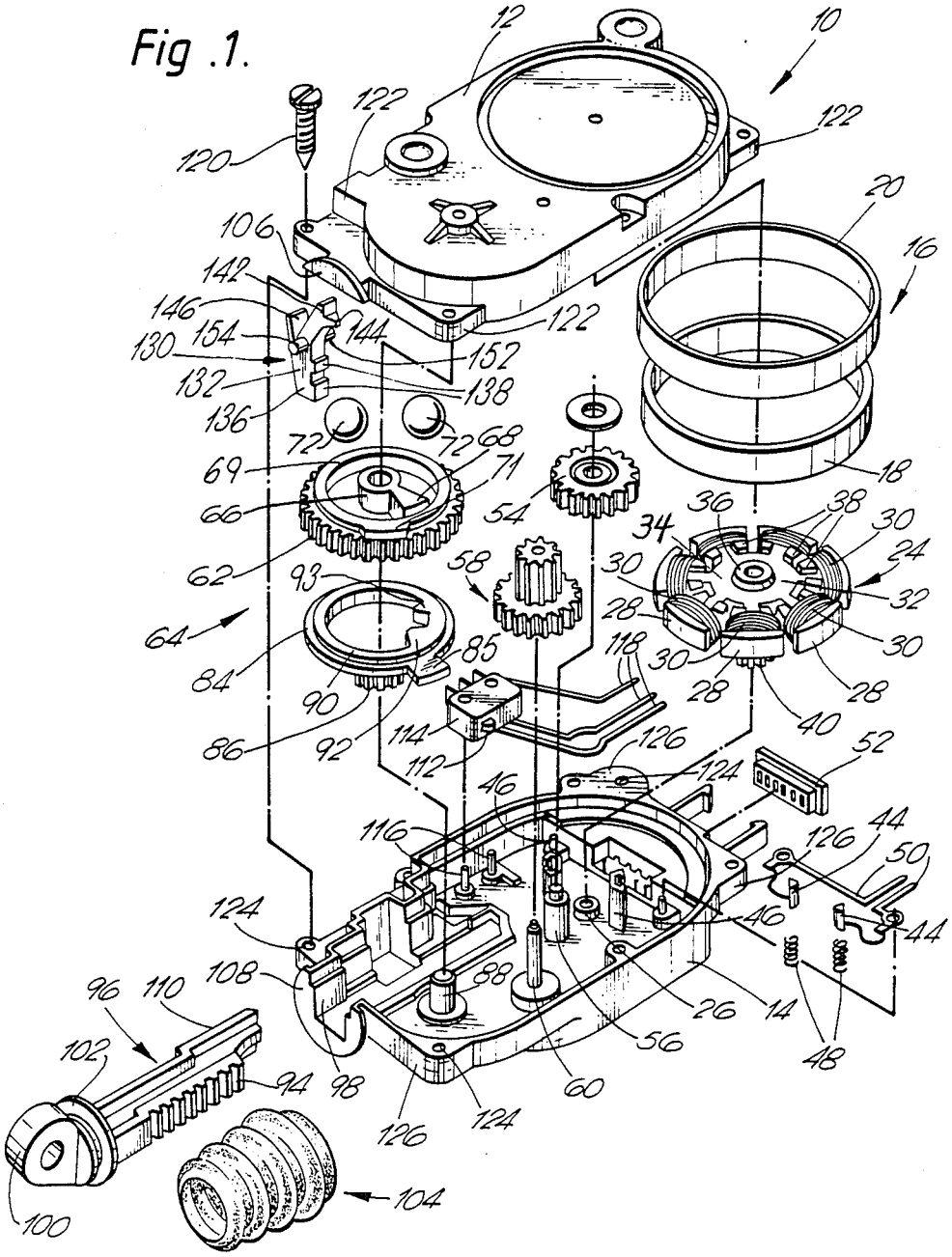
FIG. 1 is an exploded, isometric view of a centralised door lock actuator according to a preferred embodiment of the present invention.

As can be seen in FIG. 1 of the drawings, a centralised door lock actuator 10 according to the present invention comprises a moulded housing of synthetic plastics material formed into inter-engaging sections 12, 14, the upper housing section 12 housing a permanent magnet stator 16 in the form of a cylindrical composite ring made up of a permanent magnet inner ring 18 and a steel outer ring 20, said steel outer ring 20 fitting within a corresponding cylindrical bore within the upper section 12 of the housing. The internal diameter of the permanent magnet inner ring 18 is at least twice the actual length of this inner ring 18, and, in this particular embodiment of the invention, the internal diameter of the permanent magnet inner ring 18 is three times the actual length of the ring. Mounted coaxially within the cylindrical bore in the upper section 12 is a steel shaft 22 (FIG. 2) on which is rotatably mounted a coil-wound armature 24. The free end of the steel shaft 22 locates in a bushing 26 in the lower section 14 of the housing when the upper section 12 is located in position upon the lower section 14.

Figure 2:
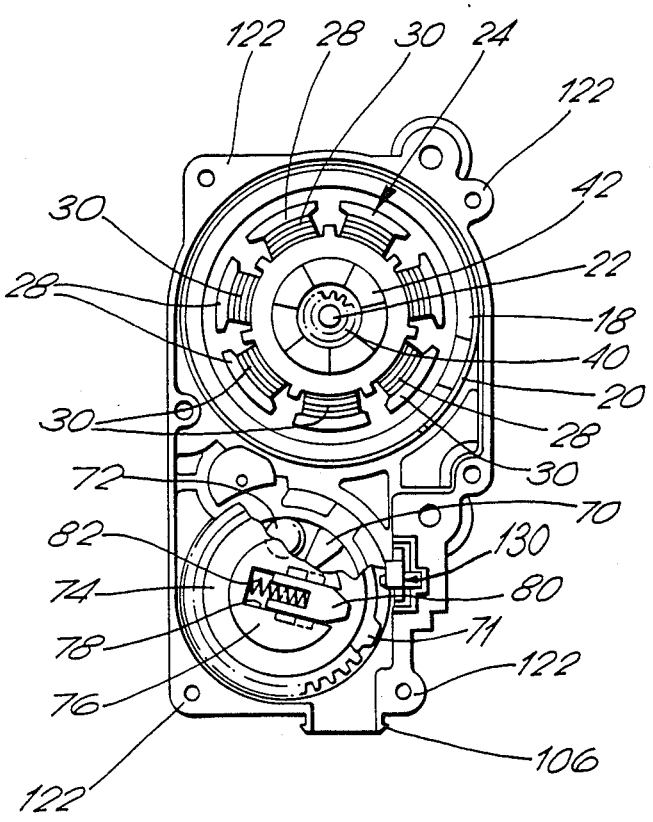
FIG. 2 is a view of an upper portion of the actuator shown in FIG. 1, with the components in position.

The coil-wound armature 24 is in the form of a salient pole rotor having seven pole sections 28, each of which is provided with a coil winding 30. Each pole section 28 is made of steel and extends from an inner ring 32, also of steel. Concentric with this inner ring 32 is a synthetic plastics moulding 34 in the shape of a disc carrying on one side thereof a moulded central bushing 36 for the armature shaft 22 and seven bifurcated legs 38, each of which locks into position over a respective one of said pole sections 28. On the other side of the synthetic plastics moulding 34 is a coaxial integral pinion output gear 40, through which extends the free end of the armature shaft 22. As can be seen in FIG. 2 of the drawings, the other side of the synthetic plastics moulding 34 also houses an annular disc-shaped segmented commutator 42 (FIG. 2) which is concentric with the pinion output gear 40. Both the armature 24 and the integral pinion output gear 40 are free to rotate upon the armature shaft 22. Electric current is fed to the armature 24 through two carbon brushes 44, each of which is slidably mounted in a respective integrally moulded brush holder 46 in the lower section 14 of the housing, and is spring-biased into contact with the segmented commutator 42 by means of a respective coil spring 48. Each carbon brush 44 is electrically connected to a respective terminal pin 50 which extends through the end of the lower section 14 of the housing and through a respective slot in a rubber grommet 52 which serves to isolate the interior of the housing of the actuator 10 from the ingress of dust and moisture.

The integral pinion 40 of the armature 24 meshes with a gear wheel 54 which is rotatably mounted upon an upstanding steel shaft 56 insert-moulded in the lower section 14 of the housing. Gear wheel 54 also meshes with a gear wheel portion of a combined gear wheel and pinion 58 which is rotatably mounted upon a shaft 60 mounted within the lower section 14 of the housing. The pinion portion of the combined gear wheel and pinion 58 meshes with a toothed wheel 62 which forms a driving member of a rotary clutch 64. Toothed wheel 62 has on one side thereof an integral concentric bushing 66 from which extends a radial projection 68. Toothed wheel 62 is pivotally mounted upon a stub axle (not shown) which is integrally moulded into the base of the upper section 12 of the housing. A radially extending stop means 70 (see FIG. 2) is formed in the base of the upper section 12 of the housing, and two balls 72 of resilient rubber are positioned between the toothed wheel 62 and the base of the upper section 12 of the housing so that the balls 72 lie either side of the radial projection 68.

An integral upstanding annular rim 69 is positioned on toothed wheel 62 concentric with bushing 66, and has formed thereon an outwardly-extending integral cam portion 71.

As can be seen in FIG. 2, the other side of the toothed wheel 62 has formed therein an annular channel 74 encircling a central boss 76, which central boss includes a radially-extending channel 78 in which is slidably mounted a radially-extending tooth 80. The radially-extending tooth 80 is spring-biased towards the periphery of the toothed wheel 62 by means of a coil spring 82.

Toothed wheel 62 engages with a driven member of the clutch 64 in the form of an integrally moulded disc 84 having moulded on one side thereof a co-axial bushing 86 provided with gear teeth. The disc 84 is pivotally mounted upon the lower section 14 of the housing by the engagement of this bushing upon a stub axle 88 extending from the base of the lower section 14. The other side of the disc 84 is provided with a depending annular skirt 90, the external diameter of which is such that the annular skirt 90 is a sliding fit within the annular channel 74 of toothed wheel 62. There is a first tooth-like projection 92 on the annular skirt 90 which radially extends towards the centre of disc 84, and a second tooth-like projection 93 on the annular skirt which also radially extends towards the centre of disc 84. The second tooth-like projection 93 is of a similar shape to the first tooth-like projection 92, but is smaller in radial length compared to the first tooth-like projection 92. Both of these tooth-like projections 92 and 93 are dimensioned to be engagable with the tip of the spring-loaded radially-extending tooth 80 on toothed wheel 62. The peripheral edge of moulded disc 84 includes an outwardly-extending stop portion 85. This stop portion 85 is engagable with a stop member 87 located within the upper section 12 of the housing (see FIG. 4).

Figure 3:
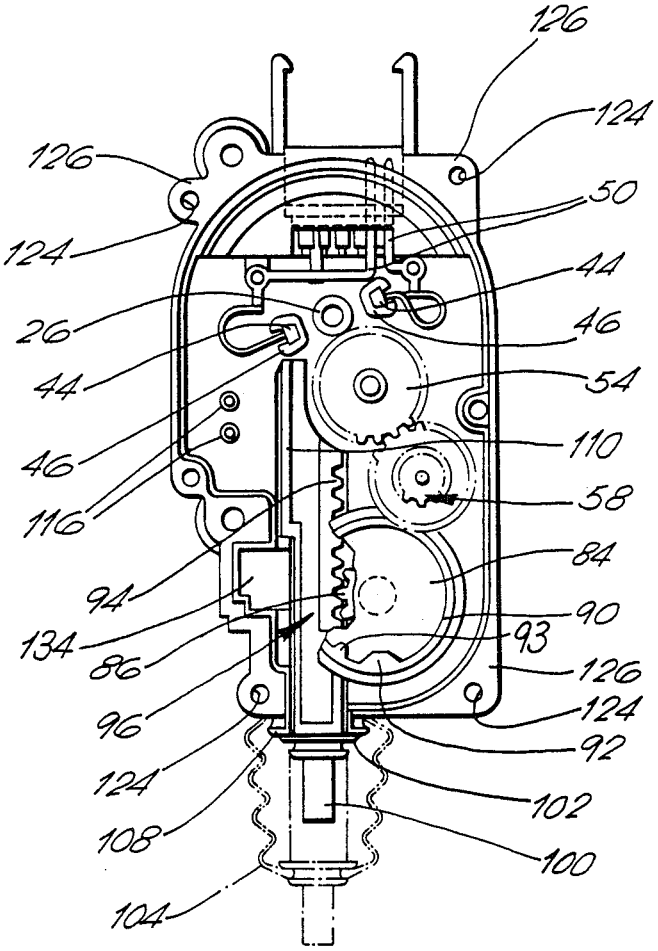
FIG. 3 shows a similar view of a lower portion of the actuator shown in FIG. 1, with some parts removed for clarity.

As can be seen in FIG. 3 of the drawings, the external gear teeth on the co-axial bushing 86 of disc 84 engage with a toothed rack 94 formed on an output member 96 which is slidably mounted within a channel-shaped recess 98 formed in the lower section 14 of the housing. Thus the output member 96 can reciprocate within the channel-shaped recess 98 in response to oscillatory motion of the disc 84 and co-axial bushing 86. One end of output member 96 is provided with an apertured lug 100 which serves as a means of coupling the output member 96 to a locking lever of a motor vehicle door latch. Adjacent the apertured lug 100 is a collar 102 formed on the output member 96, which collar 102 engages in one end of a hollow cylindrical corrugated resilient sealing member 104, the other end of which locates over collar-shaped projections 106 and 108 provided respectively on the ends of upper section 12 and lower section 14 of the housing. The sealing member 104 prevents the ingress of dust and moisture into the housing of the actuator 10, and its resiliency is such as not materially to impede the reciprocation of output member 96 within the channel-shaped recess 98.

The other end of the output member 96 is provided with a stepped configuration 110, which stepped configuration 110 is engagable with a switch element 112 of a micro-switch 114 when the output member 96 is retracted within the housing. Micro-switch 114 is mounted within the lower section 14 of the housing upon upstanding pins 116 located in lower section 14. Terminals 118 of the micro-switch 114 extend through the end of the lower section 14 and through respective apertures in the grommet for connection with control circuitry associated with the actuator 10.

The upper section 12 and the lower section 14 of the housing of the actuator 10 are releasably engaged one with the other by means of self-tapping screws 120 which pass through respective apertured lugs 122 formed on the upper section 12 and engage with bores 124 formed in similar lugs 126 formed on lower section 14.

Figure 4:
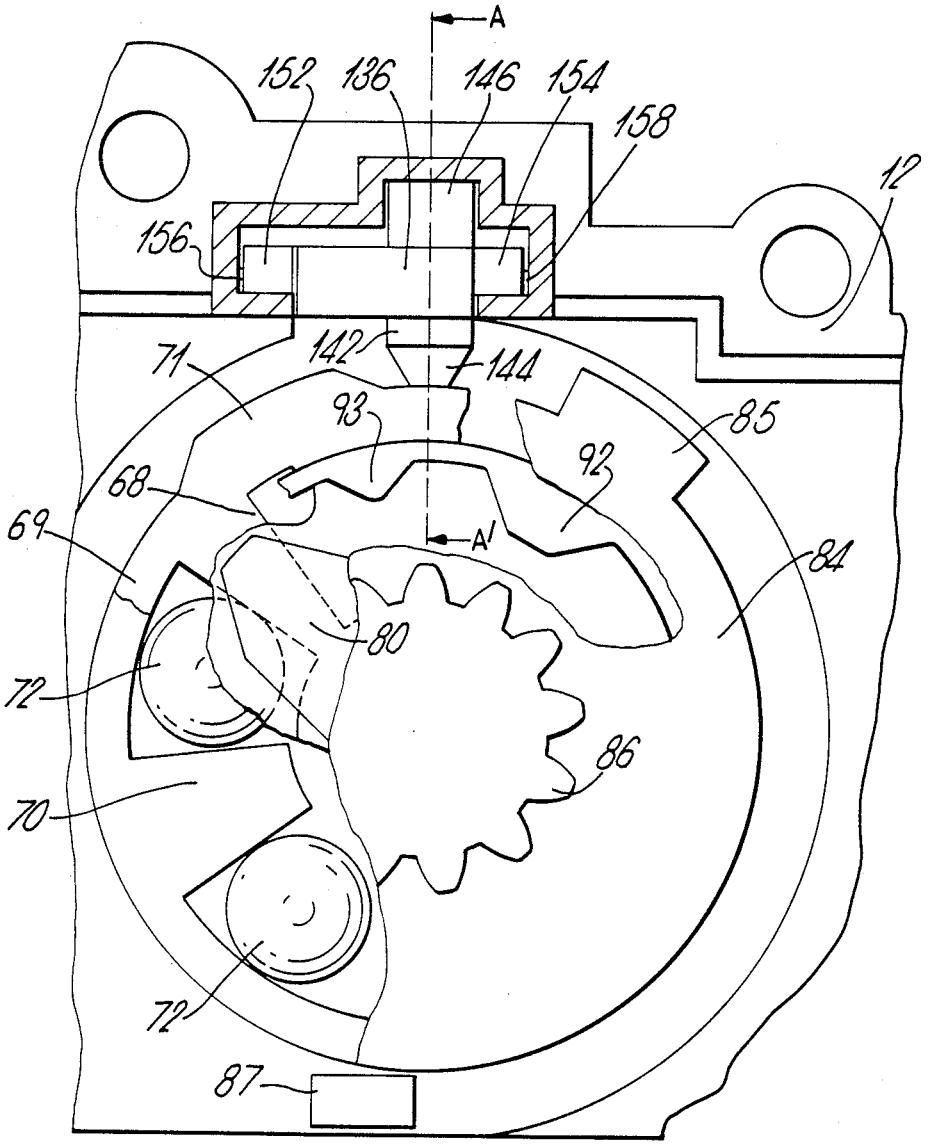
FIG. 4 shows an enlarged, scrap view of a portion of FIG. 2.
Figure 5:
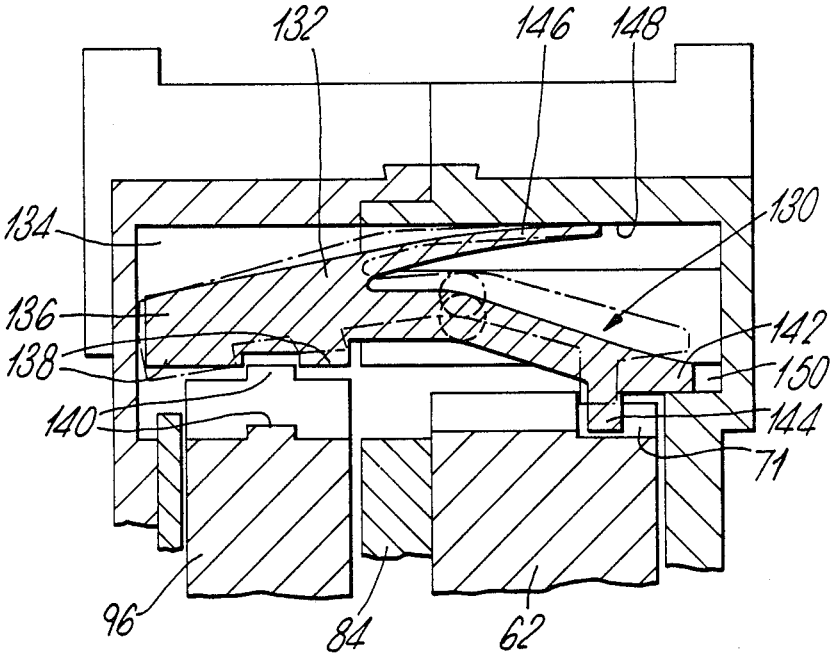
FIG. 5 shows a cross-sectional view of a portion of FIG. 4, taken on the line A—A—.

Turning now to FIGS. 4 and 5 of the accompanying drawings, these show in details the components of a "super lock" arrangement in the actuator according to the present invention in which a stop means 130 comprises a locking lever 132 which is pivotally mounted within a cavity 134 formed within, and extending across the two sections 12, 14 of the housing. One end 136 of the locking lever 132 is shaped with formations 138 thereon, which formations 138 are releasably engagable with complementary formations 140 formed upon one side of the output member 96. The other end 142 of the locking lever 132 is cranked with respect to end 136, and has a cam follower portion 144 formed thereon. The locking lever 132 is formed from a synthetic plastics material, and includes a resilient finger portion 146 which bears against an upper wall 148 of the cavity 134 in order to provide a resilient bias on the locking lever 132 so as to retain the other end 142 of lever 132 in contact with an opposite wall portion 150 of the cavity 134. In this position of the locking lever 132, the cam follower portion 144 of the other end 142 of lever 132 is retained within the path of cam portion 71 of the annular rim 69 of toothed wheel 62.

The locking lever 132 is pivotally mounted within the cavity 134 of the housing by means of integral pivot portions 152, 154 on the locking lever, each of which is retained within a corresponding substantially U-shaped pivot mounting 156, 158 formed within the upper section 12 of the housing. Each pivot portion 152, 154 is retained in contact with the bottom of the respective U-shaped pivot mounting 156, 158 by the resilient bias exerted on the locking lever 132 by the resilient finger portion 146. This means, in effect, that the locking lever 132 is pivotally mounted within the housing by a pair of floating pivot points, for a reason which will be made apparent hereinafter in the description.

As can be seen in FIG. 4 of the drawings, the second tooth-like projection 93 on annular skirt 90 is located adjacent to the first tooth-like projection 92, but does not have the radial height of projection 92. Projection 93 is designed to act as a limit stop portion for the rotary clutch 64, which limit stop portion is operable, when the locking lever 132 is applied, to prevent disengagement of the cam follower 144 from the cam portion 71 on the integral upstanding rim 69 of the toothed wheel 62. The radial height of projection 93 is such that, when the electric motor of the actuator 10 is driven with the normal operating voltage, the radially-extending tooth 80 on toothed wheel 62 over-rides projection 93, so as to move the cam portion 71 of toothed wheel 62 past the cam follower 144. This, in turn, means that the locking lever 132 will return to the position shown in the solid lines in FIG. 5 of the accompanying drawings.

Figure 6:
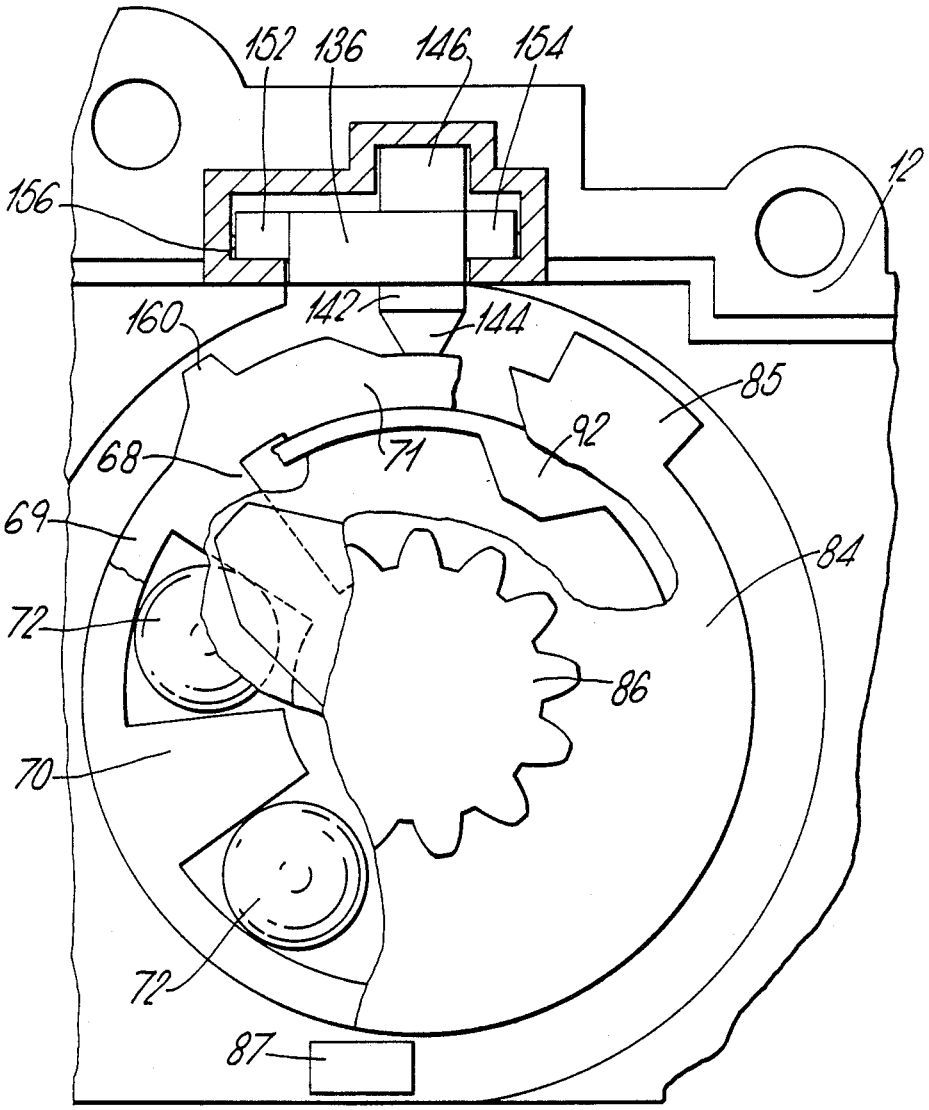
FIG. 6 shows a similar view to FIG. 4, illustrating a second embodiment of the present invention.

FIG. 6 of the accompanying drawings shows an alternative embodiment of the present invention, in which the projection 93 on the annular skirt 90 of disc 84 is replaced by a similar shaped projection 160 on the trailing end of cam portion 71. This projection 160 operates in exactly the same fashion as projection 93 in the first embodiment of this invention, the floating pivot action of locking lever 132 allowing this projection 160 to pass beneath the cam follower 144 when the electric motor of the actuator 10 is supplied with a normal operating voltage, in order to release the locking lever 132.

Figure 7:
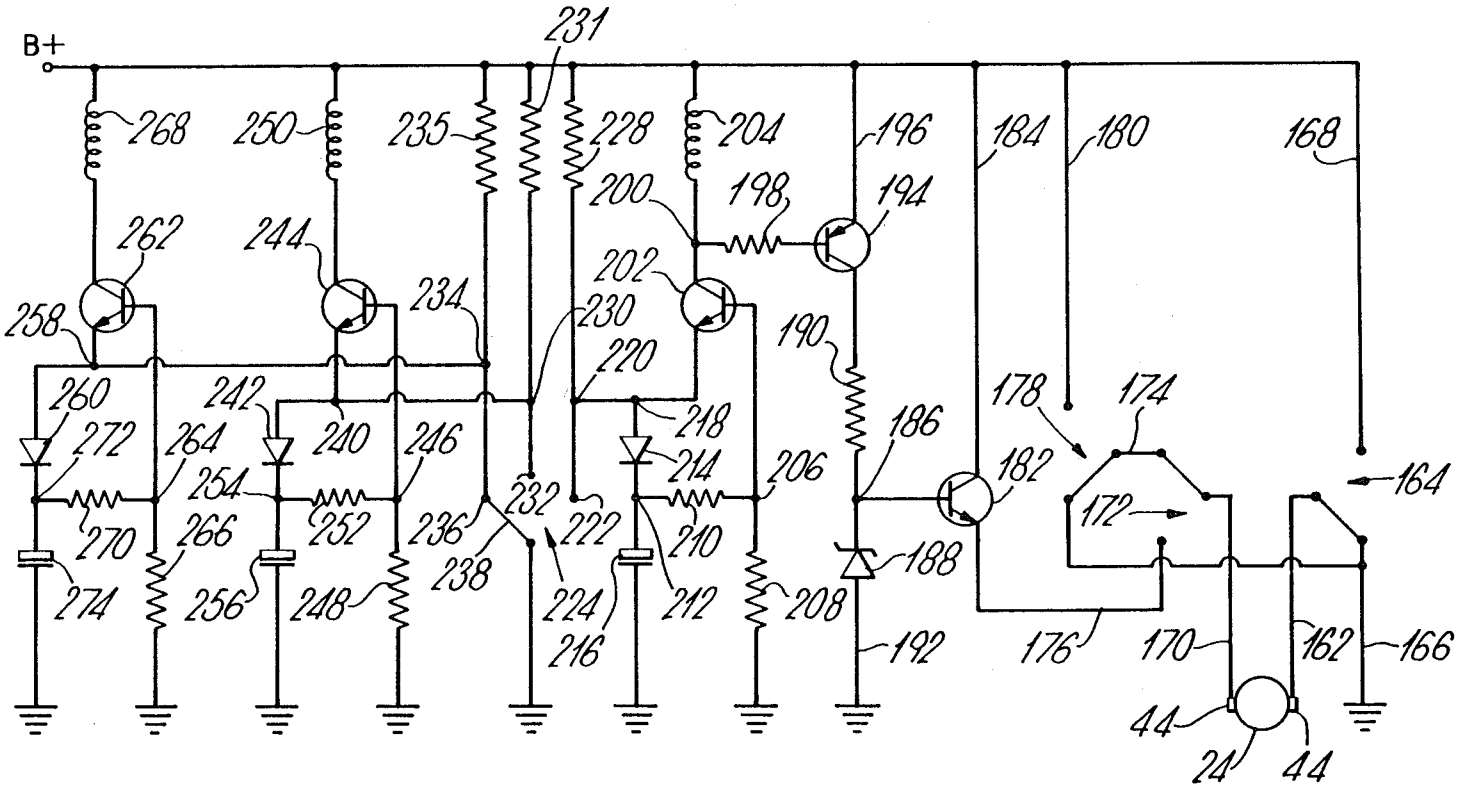
FIG. 7 shows a circuit diagram of a suitable switchable direct current electrical supply connected to the preferred embodiment of the invention shown in FIGS. 1-5 of the accompanying drawings.

FIG. 7 of the accompanying drawings shows a switchable direct current electrical supply which is suitable for supplying electrical power to the armature 24 of the actuator 10 through the carbon brushes 44. One of these brushes is connected by a line 162 to a relay 164 which is switchable between a ground potential line 166 and a battery potential line 168. The other carbon brush 44 is connected via a line 170 to a relay 172 which is switchable between a line 174 and a line 176. The line 174 is connected to a relay 178, which is switchable between ground potential line 166 and a line 180 connected to the battery potential line 168. Line 176 is connected to the emitter of an NPN transistor 182, the collector of which is connected to battery potential line 168 via a line 184, and the base of which is connected to a junction 186 between a Zener diode 188 and a resistor 190. Zener diode 188 is connected to ground potential through line 192. Resistor 190 is connected to the collector of a PNP transistor 194, the emitter of which is coupled to the battery potential line 168 through a line 196, and the base of which is coupled to a resistor 198.

Resistor 198 is coupled to a junction 200 between the collector of an NPN transistor 202 and one end of a relay coil 204 which is the operating relay coil for relay 172. The other end of relay coil 204 is connected to the battery potential line 168. The base of transistor 202 is connected via a junction 206 and a resistor 208 to ground potential. Junction 206 is connected through a resistor 210 to a junction 212 between a diode 214 and one side of a capacitor 216, the other side of the capacitor 216 being coupled to ground potential. The emitter of transistor 202 is coupled through a junction 218 to the diode 214, and through a junction 220 to one contact 222 of a three position switch 224. Junction 220 is coupled through a resistor 228 to the battery potential line 168. A second contact 232 of three-way switch 224 is connected through a junction 230 and a resistor 231 to the battery potential line 168. A third contact 236 of the three-way switch 224 is connected through a junction 234 and a resistor 235 to the battery potential line 168.

A movable switch member 238 of the three-way switch 224 serves to connect any one of the contact points 222, 232 and 236 with ground potential.

Junction 230 is connected to a junction 240 between a diode 242 and the emitter of an NPN transistor 244, the base of which is connected through a junction 246 and resistor 248 to ground potential, and the collector of which is connected to one end of a relay coil 250, which constitutes the operating coil for relay 164. The other end of relay coil 250 is connected to the battery potential line 168. Junction 246 is connected through a resistor 252 to a junction 254 between the diode 242 and one side of a capacitor 256, the other side of the capacitor 256 being connected to ground potential.

Junction 234 is connected to a junction 258 between a diode 260 and the emitter of an NPN transistor 262, the base of which is connected through a junction 264 and a resistor 266 to ground potential, and the collector of which is connected to one end of a relay coil 268, which relay coil forms the operating coil for the relay 178. The other end of relay coil 268 is connected to the battery potential line 168. Junction 264 is connected through a resistor 270 to a junction 272 between the diode 260 and one side of a capacitor 274, the other side of which capacitor 274 is connected to ground potential.

The operation of the actuator shown in FIGS. 1–5, with reference to FIG. 7, will now be described on the basis that the actuator 10 is installed in a centralised locking system in a motor vehicle in which the door latches of the vehicle are provided with locking levers which can also be actuated manually by occupants of the vehicle. Thus the output member 96 of the actuator 10 would be coupled to such a locking lever which can also be manually operated by an occupant of the motor vehicle. The terminals 50 of the actuator 10 are connected to the switchable relays 164 and 172 as shown in FIG. 7. The three-way position switch 224 of the circuit shown in FIG. 7 would be actuated by a key-operated mechanism situated in either the driver's door or, optionally, the other front door of the motor vehicle, and, as will be described in detail hereinafter, the circuits shown in FIG. 7 includes timing means which govern the length of time that electrical power can be supplied to terminals 50 upon actuation of the key-operated mechanism in the door of the vehicle.

Assume now that the vehicle door latch connected to the operating member 96 of the actuator 10 is in an unlocked condition, and that a key has been inserted in the key-operated mechanism in the vehicle door and turned to lock the vehicle door latch. When this occurs, the switch member 238 of switch 224 moves from contact 236 to contact 232, which results in junctions 230 and 240 falling to ground potential. Prior to this happening, capacitor 256 had been kept fully charged by the battery potential applied thereon through line 168, resistor 231, junction 230, junction 240, diode 242 and junction 254.

When junction 240 goes to ground potential, transistor 244 switches on, and the capacitor 256 commences to discharge to ground potential through resistors 252 and 248. Transistor 244 remains switched on until the junction 246 between resistors 252 and 248 falls to the switch-off voltage of transistor 244, which is of the order of 0.7 volts. During the period that transistor 244 is switched on, electrical current passes through relay coil 250, causing relay 164 to switch from ground potential line 166 to battery potential line 168, so as to supply electrical power of the correct polarity to terminal 50 of the actuator 10, so that armature 24 commences to rotate in the predetermined direction to cause locking of the vehicle door latch. This electrical power is supplied to the armature 24 at the normal operating voltage of the system, which is between 9 and 15 volts DC. The pinion output gear 40 on armature 24 rotates gear wheel 54 and the combined gear wheel and pinion 58, thus commencing to turn toothed wheel 62.

Toothed wheel 62, however, cannot complete a full revolution, since it is prevented from doing so by the engagement between radial projection 68 and radially-extending stop means 70 in upper section 12, through the intervening resilient rubber ball 72. When armature 24 first commences to rotate, one side of the radial projection 68 is already in contact with one side of the radially-extending stop means 70 through the intervening resilient rubber ball 72. Movement of toothed wheel 62 in response to the rotation of armature 24 moves the radial projection 68 away from the radially-extending stop means 70, and the toothed wheel 62 commences to rotate until the other side of the radial projection 68 comes into contact, through the other resilient rubber ball 72, with the other side of the radially-extending stop means 70. Consequently, toothed wheel 62 can only rotate through a predetermined angle of rotation which is always less than 360°.

At the commencement of movement of toothed wheel 62, the cam follower 144 of the locking lever 132 is resting on the rim 69 of toothed wheel 62, and the locking lever 132 is in the position shown in the solid lines in FIG. 5. Consequently, the end 136 of locking lever 132 is located out of the path of movement of the operating member 96. Upon movement of toothed wheel 62, one side of the radially-extending tooth 80 on toothed wheel 62 comes into contact with one side of the first tooth-like projection 92 on disc 84, so that disc 84 becomes entrained with toothed wheel 62 and commences to move in the same direction. At the commencement of movement of disc 84, the output member 96 is extended as far from the housing of the actuator 10 as is required to keep an associated locking lever of the motor vehicle door latch to which the actuator 10 is coupled in the unlocked position for the door latch. Upon the commencement of movement of the disc 84, the simultaneous movement of the gear teeth on co-axial bushing 86 and the engagement thereof with the toothed rack 94 on output member 96 commences to retract output member 96 within the housing of the actuator 10. This movement, in turn, causes the corresponding movement of the associated locking lever to cause the motor vehicle door latch to go to a locked condition.

The associated locking lever reaches the end of its travel to place the vehicle door latch into a locked condition before the toothed wheel 62 reaches the end of its travel. Consequently, further inward movement of the output member 96 is blocked, and, due to the positive engagement of the gear teeth on co-axial bushing 86 with the corresponding gear teeth on the toothed rack 94, the disc 84 becomes stationary. When this occurs, the continuing motion of the toothed wheel 62 presses the spring-loaded radially-extending tooth 80 harder against now-stationary first tooth-like projection 92. Both the radially-extending tooth 80 and the first projection 92 are provided with similarly shaped sloping cam surfaces, and the increasing load exerted on the first projection 92 by the radially-extending tooth 80 becomes sufficient to cause the radially-extending tooth 80 to retract within the radially-extending channel 78 against the spring-bias of the coil spring 82 until the tip of the radially-extending tooth 80 is freed from the tip of the first projection 92.

Once this occurs, toothed wheel 62 continues to rotate, causing the cam portion 71 of the rim 69 to come into contact with the cam follower 144 of locking lever 132. When this occurs, the locking lever 134 pivots in the U-shaped pivot mountings 156, 158 so that the formations 138 on the end 136 engage with the complementary formations 140 on the output member 96. Toothed wheel 62 continues to rotate until the radially-extending tooth 80 comes into contact with the second tooth-like projection 93 on disc 84. Since the second projection 93 has an radial height which is less than the radial height of the first projection 92, the radially-extending tooth 80 rides over the second projection 93 without undue hindrance, and the toothed wheel 62 continues to rotate until the other side of the radial projection 68 comes into contact, through resilient rubber ball 72, with the other side of the radially-extending stop means 70. As this final stage of rotation of the toothed wheel 62 occurs, the cam follower 144 of the locking lever 132 moves off the cam 71 on rim 69, and returns to the position shown in FIG. 4 of the drawings. Consequently, end 136 of the locking lever 132 is lifted out of the path of movement of the output member 96, as shown in FIG. 5 of the drawings.

When the other side of radial projection 68 comes into contact, through resilient rubber ball 72, with the other side of the radially-extending stop means 70, toothed wheel 62 ceases to move, the locking lever 132 is in the position shown in FIG. 5, and the armature 24 is brought to rest. Shortly after this occurs, capacitor 256 discharges to a voltage less than the switch-off voltage of transistor 244, thus switching off transistor 244, stopping the current flow to relay coil 250, which, in turn, causes relay 164 to switch from the battery potential line 168 to the ground potential line 166, thus de-actuating the reversible electric motor 16. The door latch associated with the actuator 10 is now in a locked condition, and the actuator 10 is de-activated.

Consider now that an occupant of the motor vehicle may now decide to unlock the vehicle door latch by means of manually operating the locking lever associated with the output member 96. Movement of this associated locking lever to do this will result in a force being applied to the output member 96 to withdraw it from the housing of the actuator 10. Due to the positive engagement between the toothed rack 94 on the output member 96 and the gear teeth on the co-axial bushing 86 of disc 84, this outward movement of the output member 96 will cause movement of disc 84 in the opposite direction to that in which it was moved by the toothed wheel 62. Since, during the operation of the actuator 10, the radially-extending tooth 80 passed over the first projection 92 and the second projection 93, they are no longer in contact, and the disc 84 is thus free to move until the manual operation of the locking lever has been completed. Thus, throughout this movement, the occupant of the vehicle has not had to apply any substantial effort to unlocking the door latch mechanism over and above the normal effort required to move the operating components of the door latch assembly themselves. When the manual operation of unlocking the door latch ceases, the second projection 93 is positioned adjacent to the radially-extending tooth 80, but not in contact with it. Consequently, at no time during manual actuation of the locking lever is there any direct mechanical engagement between the projections 92, 93 and radially-extending tooth 80. It will be clearly understood, of course, that, if the occupant so desires, the door latch mechanism can be returned to its locked state from its unlocked state by manual operation without undue difficulty by an occupant of the motor vehicle, since the rotary clutch 64 remains disengaged all of the time that the electric motor 16 is de-activated.

If it is now decided to utilise the "super lock" feature of the actuator 10, the key in the key-operated mechanism is now turned so as to move switch member 238 from the contact 232 to the contact 222 of switch 224. When this occurs, junctions 220 and 218 are connected to ground potential, and the electrical supply to the capacitor 216 through battery potential line 168, resistor 228, junction 220, junction 218, diode 214 and junction 212 is interrupted, and the fully charged capacitor 216 commences to discharge through resistors 210 and 208 to ground potential. As soon as junction 218 is coupled to ground potential, transistor 202 switches on, causing electrical current to flow through relay coil 204, thus causing relay 172 to switch from line 174 to line 176.

The flow of electrical current through relay coil 204 into the base of transistor 194 through resistor 198 switches on transistor 194, supplying battery potential to junction 186 through battery potential line 168, line 196 and resistor 190. The Zener diode 188 connected to 186 has a break-down voltage of the order of 3.9 volts, which ensures that the voltage at junction 186, and at the base of transistor 182, remains at approximately 3.9 volts. This voltage switches on transistor 182, to supply a current at a voltage of 3.2 volts to line 176. Consequently, armature 24 of motor 16 is provided with an electrical pulse at a lower voltage than the normal operating voltage of the electric motor 16, this lower voltage being sufficient to cause the armature 24 to commence to rotate in the opposite, unlocking, direction. The duration of this electrical pulse is governed by the electrical parameters of capacitor 216 and resistors 210 and 208, and is just sufficient to turn the toothed wheel 62 in the opposite direction so as to bring the radially-extending tooth 80 into contact with the second projection 92 on disc 84.

During this limited movement of toothed wheel 62, the cam 71 on rim 69 comes into contact with the cam follower 144 on the locking lever 132, and the locking lever 132 pivots to engage the formations 138 on the end 136 with the complementary formations 140 on the output member 96. When this occurs, the end 136 of the locking lever 132 effectively blocks any reciprocable movement of the output member 96.

When the radially-extending tooth 80 on toothed wheel 62 comes into contact with the second projection 93, the torque developed by motor 16 under the low voltage pulse from relay 172 is insufficient to cause the radially-extending tooth 80 to ride over the second projection 93 on disc 84, and, since disc 84 is immobilised by reason of the locking lever 132 preventing movement of the output member 96, the armature 24 will cease to rotate and the electric motor 16 will stall until the low voltage pulse through relay 172 ceases. This low voltage pulse 172 ceases when capacitor 216 discharges to such an extent that junction 206 falls to a voltage corresponding to the switch-off voltage for the transistor 202. Once transistor 202 switches off, current ceases to flow in relay coil 204, and relay 172 switches from line 176 to line 174, thus isolating the armature 24 from any supply of electrical power. The actuator 10 is now in the "super lock" position where the door latch mechanisms are in a position where they cannot be released manually. Consequently, the doors of the motor vehicle are guarded against the possibility of being opened by someone endeavouring to force an entry into the vehicle by the manipulation of the manual controls of the door latch mechanisms.

The "super lock" feature of the actuator 10 can be disengaged by turning the key in the key-operated mechanism in order to move the switch member 238 from the position in which it makes contact with switch contact 222 into a position in which it makes contact with switch contact 232. With the switching member 238 in this position, the relay coil 250 becomes energised, causing relay 164 to switch from the ground potential line 166 to the battery potential line 168, and thus drive the armature 24 in the locking direction for the motor vehicle door latch mechanism, thus causing the toothed wheel 62 to rotate to the position shown in FIG. 4 of the drawings, where the radial projection 68 comes into contact, through resilient rubber ball 72 with the radially-extending stop means 70. As before, when this occurs, toothed wheel 62 ceases to move, and the armature 24 is brought to rest. In this process, the cam 71 disengages from the cam follower 144, thus allowing the locking lever 132 to return to the position shown in FIG. 5 of the drawings, thus releasing the output member 96 for any subsequent movement. As before, once capacitor 256 has discharged sufficiently to switch off transistor 244, relay 164 switches back to the ground potential line 166 to cut off the supply of electrical power to the armature 24. The actuator 10 is now de-activated, and the "super lock" feature is disengaged, so that manual operation of the latch mechanism can now take place.

If the key in the key-operated mechanism is now turned so as to signal for movement of the door latch mechanism from its locked position to its unlocked position, the switch member 238 is moved from its connection with contact 232 into contact with switch contact 236. When switch member 238 of switch 224 is in this position, junctions 234 and 258 are connected to ground potential, causing transistor 262 to switch on, thus energising relay coil 268. This, in turn, causes relay 178 to switch from the ground potential line 166 to the battery potential line 168 through line 180, so as to supply electrical power to the armature 24 of the motor 16 to revolve the armature 24 in the reverse, unlocking direction. The electrical power supplied to the armature 24 under these circumstances is supplied at the normal operating voltage for the electric motor 16 of the actuator 10. As armature 24 rotates, this, in turn, commences to turn the toothed wheel 62 in the opposite direction, so bringing the radially extending tooth 80 into contact with the second projection 93 on disc 84. As this occurs, the cam 71 engages the cam follower 144 of locking lever 132, thus pivoting the locking lever 132 to engage the end 136 thereof with the output member 96. This initially locks both the output member 96 and the disc 84 against any movement. Consequently, the second projection 93 is immovable when the radially-extending tooth 80 first comes into contact with it. The torque exerted by the motor 16 under the normal operating voltage is such that the radially-extending tooth 80 over-rides the second projection 93, and the toothed wheel 62 continues its movement until the radially-extending tooth 80 comes into contact with the first projection 92. As this occurs, the cam 71 on toothed wheel 62 passes out of contact with the cam follower 144, thus allowing the locking lever 132 to return to the position shown in FIG. 5 of the drawings, thus releasing the output member 96 for subsequent movement.

When the radially-extending tooth 80 comes into contact with the first projection 92, toothed wheel 62 entrains disc 84, and the subsequent rotation of disc 84 causes the movement of output member 96 outwardly from the housing of the actuator 10. This movement of the output member 96 will continue until the stop means 85 on moulded disc 84 comes into contact with the stop means 87 in upper section 12 of the actuator 10. During this process, the vehicle door latch mechanism will have moved to its unlocked position.

Once the stop means 85 on disc 84 comes into contact with the stop means 87 on the housing, disc 84 will come to a halt, and toothed wheel 62 will continue to move, causing the spring-biased radially-extending tooth 80 to ride over the first projection 92 to allow the toothed wheel 62 to move to the end of its travel. Once again, the toothed wheel 62 reaches the end of its travel shortly before the capacitor 274 discharges to a sufficient extent to switch off transistor 262 to cut off the supply of electric power to the electric motor 16.

It will be appreciated, of course, that if an occupant of the vehicle has previously unlocked the door latch mechanism, then entrainment of the disc 84 by engagement of the radially-extending tooth 80 with the first and second projections 92, 93 does not occur until the point is reached at which the radially-extending tooth 80 is due to override these two projections. Thus, in effect, when the door latch is in the unlocked condition, the radially-extending tooth 80 moves away from one side of the first projection 92 around the circumference of the annular skirt 90 until it comes into contact with the projection 93. Once this occurs, the increasing load exerted on the radially-extending tooth 80 by the movement of toothed wheel 62 causes the radially-extending tooth 80 to override both of the projections 92, 93, and thus release the clutch 64. Moreover, it will be realised that, with the door latch in the unlocked condition and the actuator 10 de-activated, an occupant of the motor vehicle can, again, manually operate the mechanism of the door latch freely without hindrance from the actuator 10.

The actuator 10 shown in FIGS. 1–5 is a master actuator, for use in centralised door locking systems in which it is possible to lock and unlock all of the door latch mechanisms through key-operated mechanisms located in both the driver's door and the other front door of the motor vehicle. Thus this actuator 10 includes the micro-switch 114, the switching element 112 of which is actuated by contact with the stepped configuration 110 of the output member 96 when that output member 96 retracts into the housing of the actuator 10. The micro-switch 114, when so actuated, then switches on other door lock actuators of the same type located in the other doors of the vehicle, the actuators in the rear doors of the motor vehicle being of the same construction, but omitting the micro-switch 114. Manual operation of an actuator 10 as shown in the drawings will result in all of the door latch mechanisms being operated together, due to the switching action of the micro-switch 114. The actuators employed in the rear doors of the vehicle, since they do not incorporate such a micro-switch 114, will not produce a centralised door-locking action when either of the door latches in the rear doors of the vehicle are manually locked or unlocked.

It will be understood from the preceding description that the angular extent to which the disc 84 can be turned is a predetermined amount less than the angular distance through which the toothed wheel 62 is moved during the actuation of the electric motor 16, so to ensure that the radially-extending tooth 80 over-rides the projections 92, 93 before the toothed wheel 62 reaches the end of its travel in either direction. This limitation of the angular movement of disc 84 is preferably produced by the extent of travel of the locking lever of the associated door latch mechanism. The output member 96, however, is provided with its own integral stop means to govern the extent of movement of the output member 96 in one direction, and the disc 84 is provided with its own integral stop means 85 to govern the movement of the output member 96 in the opposite direction. In practice, the maximum movement possible for output member 96 exceeds the distance through which the locking lever of the associated door latch mechanism has to move in order to move the door latch mechanism from a locked to unlocked state, and vice-versa. It will be understood that the provision of the maximum movements of the output member 96 ensures that the actuator 10 can be used to operate a variety of commercially available motor vehicle door latch mechanisms.

The "super lock" feature specifically described in the actuator shown in FIGS. 1-5 of the accompanying drawings is arranged to operate when the locked condition of the associated door latch mechanism corresponds to the output member 96 being retracted within the housing of the actuator 10. It will be appreciated, however, that it would be relatively simple to modify this "super lock" feature to ensure that it can be applied when the locked condition of the motor vehicle door latch mechanism corresponds to a position in which the output member 96 is fully extended from the housing of the actuator 10.

In the event that, for any reason, output member 96 is not in the correct position, when locking lever 132 is pivoted by the engagement of cam portion 71 with cam follower 144, to engage the end 136 of the locking lever 132, the resilient nature of locking lever 132 allied with the floating pivots thereof, allows the locking lever to deform to the position shown in the dotted lines in FIG. 5, thus avoiding the possibility of the actuator jamming in such an event.

The actuator of the present invention is a compact, ingenious modification of the actuator disclosed in and claimed in our co-pending British patent application No. 8412861, and provides a simple, yet effective, means of obtaining a "super lock" feature to such an actuator. The use of such actuators with "super lock" features according to the present invention materially improves the security of the motor vehicles in which they are fitted.

The embodiments of the invention in which an exclusive property or privilege is claimed are defined as follows:

1. An electrically-operable actuator for use in locking and unlocking a latch mechanism in a motor vehicle by the selective operation of a switchable direct current electrical supply to said actuator, which actuator comprises a housing enclosing a reversible direct current electric motor adapted to be coupled to said electrical supply, a reduction gear train, a reciprocable member movable between two predefined limits and adapted at one end to be coupled with a locking lever of said latch mechanism, and a clutch means provided between said reversible electric motor and said reciprocable member, characterised in that said clutch means is a rotary, load-sensitive releasable coupling within said reduction gear train which disengages said reciprocable member from said reversible electric motor at either end of said predetermined limits; and the actuator includes a releasably-engagable stop means between said housing and said reciprocable member which is operable to lock said reciprocable member against any movement relative to said housing, said stop means being applied, when said actuator is coupled to said switchable electrical supply and after one of said predetermined limits has been reached, by the operation of a switch means in said supply to provide an electrical pulse to said electric motor at a predetermined voltage, lower than the normal operating voltage of said electric motor, for a predetermined short period of time.

2. An electrically-operable actuator according to claim 1, in which said stop means is operable by reversing the direction of rotation of said electric motor once said one predetermined limit has been reached.

3. An electrically-operable actuator according to claim 2, in which the stop means is a locking lever pivotally mounted within said housing, and having one end thereof shaped with formations thereon releasably engagable with complementary formations on said reciprocable member, and the other end thereof shaped with a cam follower thereon, said locking lever being resiliently biased to retain the cam follower thereon in the path of a cam portion formed upon a driving member of the releasable coupling.

4. An electrically-operable actuator according to claim 3, in which said locking lever is formed from a synthetic plastics material and includes a resilient finger portion which bears against a portion of the housing to provide the resilient bias on the locking lever.

5. An electrically-operable actuator according to claim 4, in which the locking lever is pivotally mounted within the housing by means of integral pivot portions of said locking lever, each of said integral pivot portions is retained within a corresponding, substantially U-shaped pivot mounting in the housing to produce a respective floating pivot point for said locking lever.

6. An electrically-operable actuator according to claim 5, in which the releasable coupling is provided with a limit stop portion which is operable, when the stop means is applied, to prevent diengagement of said cam follower from said cam portion, said limit stop portion being over-ridden when the electric motor of the actuator is driven with said normal operating voltage.

7. An electrically-operable actuator according to claim 6, in which the limit stop portion is located on a driven member of the releasable coupling.

8. An electrically-operable actuator according to claim 6, in which the limit stop portion is located on the driving member of the releasable coupling.

* * * * *